United States Patent [19]

Kurio et al.

[11] 4,025,247

[45] May 24, 1977

[54] CORNER SEAL

[75] Inventors: Noriyuki Kurio, Fuchu; Tadashi Ebihara, Hatogaya, both of Japan

[73] Assignees: Toyo Kogyo Co., Ltd., Fuchu; Nippon Piston Ring Co., Ltd., Tokyo, both of Japan

[22] Filed: Feb. 19, 1976

[21] Appl. No.: 659,196

[30] Foreign Application Priority Data

Feb. 19, 1975 Japan ..... 50-21879[y]

[52] U.S. Cl. ..... 418/120

[51] Int. Cl.[2] ..... F04C 27/00

[58] Field of Search ..... 418/120, 121, 122, 418/123, 124, 142

[56] References Cited

UNITED STATES PATENTS

| | | | |
|---|---|---|---|
| 3,180,560 | 4/1965 | Paschke | 418/124 X |
| 3,674,384 | 7/1972 | Larrinaga et al. | 418/120 |
| 3,830,600 | 8/1974 | Shimosi et al. | 418/121 X |
| 3,961,871 | 6/1976 | Kurio | 418/121 |

*Primary Examiner*—Carlton R. Croyll
*Assistant Examiner*—Leonard Smith
*Attorney, Agent, or Firm*—Sughrue, Rothwell, Mion, Zinn & Macpeak

[57] ABSTRACT

A corner seal member for use in a rotary internal combustion engine is constructed with an apex seal groove and an elongated cavity. The elongated cavity forms a thin wall having a substantially semicircular cross-section in the opposite side of the apex seal groove. The gas pressure delivered into the elongated cavity is advantageously used for urging the corner seal towards the inner surface of the corner seal groove, thereby preventing the gas pressure from leaking into an adjacent working chamber.

2 Claims, 2 Drawing Figures

CORNER SEAL

BACKGROUND OF THE INVENTION

The invention relates to an improved corner seal member for use in a rotary internal combustion engine.

Prior corner seals, shown in FIG. 1, are formed with an apex seal groove 2 and without any other cavity. During operation, the apex seal groove 2 is supplied with pressure gas 5 through the space between the rotor housing 3 and the rotor 4. Although the gas pressure acts against the groove surface, the corner seal is too thick in the portions *a* and b and too rigid to widen outwards. Therefore, the gas pressure in the apex seal groove will escape through the clearance between the corner seal 1 and the rotor 4 into the adjacent working chamber. This leads to considerable pressure loss.

SUMMARY OF THE INVENTION

The present invention is an improved corner seal member constructed with an apex seal groove and an elongated cavity connected to the apex seal groove. The elongated cavity forms a thin wall having a substantially semicircular cross-section in the opposite side of the apex seal groove, thereby permitting the gas pressure delivered into the elongated cavity to widen the corner seal member outwards.

The corner seal member of the present invention is simple in construction and efficient to prevent the gas pressure from leaking into another working chamber.

DETAILED DESCRIPTION OF THE PREFERRED EMBODIMENT

Figure 1:
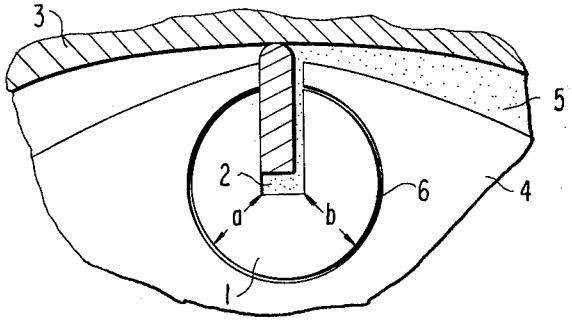
FIG. 1 PRIOR ART
FIG. 1 is an elevational view of a conventional corner seal member.
Figure 2:
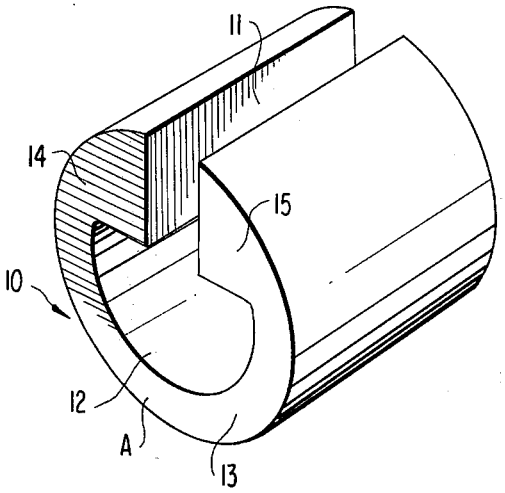
FIG. 2 is a perspective view of one embodiment in accordance with the invention.

The present invention, shown in FIG. 2, is an improved corner seal member 10 for use with a apex seal, the combination being positioned into a rotor corner seal groove in the same manner as the prior art shown in FIG. 1. The corner seal member 10 is made of sintered alloy, cast iron, or the like and is constructed with an axially extending apex seal groove or slit 11 formed in the thick wall portion of the member and an elongated cavity 12 communicating with the apex seal groove 11.

The elongated cavity 12 has such a cross-section as to form a substantially semicircular thin wall 13 in the opposite side of the apex seal groove 11. The thin wall 13 is required to have a uniform thickness for obtaining even stress distribution thereover. The thickness of the thin wall 13 is important. A corner seal having a thin wall thickness that ranges from 3% to 25% of the corner seal member outer diameter has proven satisfactory. If it is smaller than this range, the corner seal, which operates for a long period under severe conditions such as high temperature, high pressure, and high rotating speed, will break due to repeated stress. If it is larger, the corner seal member is too rigid to widen outwards under the gas pressure delivered in the elongated cavity 12. This spoils its sealing effect and leads to a considerable pressure loss.

Furthermore, the corner seal member 10 has thick walls 14 and 15 in its upper portion in order to widen its contact area relative to the apex sea. This diminishes the increase in apex seal groove wear.

The operation, gas pressure is delivered through the apex seal groove 11 into the elongated cavity 12 to act against the inner surface of the corner seal member 10 with even stress distribution. This gas pressure urges the corner seal member walls 13, 14 and 15 towards the inner surface of the corner seal groove for sealing cooperation therewith, thereby minimizing the gas leakage into the adjacent working chamber.

What is claimed is:

1. A corner seal member for a rotary internal combustion engine, said member being of a generally hollow cylindrical shape having an outer diameter suitable for fitting in a corner seal groove of a rotor of said rotary internal combustion engine, the wall of said member being relatively thin over a semicircular portion thereof to define a half moon opening in said member wherein a gas pressure in said half moon opening will press the outer walls of said cylinder against said corner seal groove, the remaining portion of said wall being relatively thick compared to said thin portion and defining an elongated axial groove for fitting an axial seal therein.

2. A corner seal member as claimed in claim 1 wherein said thin wall portion has a thickness of 3% to 25% of the diameter of said member.

* * * * *